US008125167B1

(12) United States Patent
Mullet et al.

(10) Patent No.: US 8,125,167 B1
(45) Date of Patent: Feb. 28, 2012

(54) MOTORIZED BARRIER ADJUSTMENT APPARATUS AND METHOD

(75) Inventors: Willis Jay Mullet, Gulf Breeze, FL (US); Doug Real, Pensacola, FL (US); Richard Bardin, Milton, FL (US); Darrin W. Brunk, Pensacola, FL (US)

(73) Assignee: Homerun Holdings Corporation, Pensacola, FL (US)

( * ) Notice: Subject to any disclaimer, the term of this patent is extended or adjusted under 35 U.S.C. 154(b) by 631 days.

(21) Appl. No.: 12/287,001

(22) Filed: Oct. 3, 2008

(51) Int. Cl.
*E05F 15/10* (2006.01)

(52) U.S. Cl. ..... 318/265; 318/286

(58) Field of Classification Search ..... 318/256, 318/264–266, 283, 286, 466–469
See application file for complete search history.

(56) References Cited

U.S. PATENT DOCUMENTS 2,955,817 A * 10/1960 Campbell et al. ..... 49/103
(Continued)

*Primary Examiner* — Bentsu Ro
(74) *Attorney, Agent, or Firm* — J. Nevin Shaffer, Jr.

(57) ABSTRACT

A motorized barrier adjustment apparatus and method includes, in particular, in accordance with one embodiment, motorized barrier adjustment apparatus with a barrier. A controllable motor is connected with the barrier, the controllable motor is conformed to detect motion of the barrier such that movement of the barrier within a predetermined amount activates the motor to move the barrier and where movement of the barrier beyond the predetermined amount does not activate the motor such that the barrier remains where it is moved.

19 Claims, 5 Drawing Sheets

U.S. PATENT DOCUMENTS

| | | | | | |
|---|---|---|---|---|---|
| 4,364,202 | A | * | 12/1982 | Zavatkay | 49/352 |
| 4,394,605 | A | * | 7/1983 | Terazawa | 315/280 |
| 4,476,416 | A | * | 10/1984 | Licata et al. | 318/283 |
| 4,562,387 | A | * | 12/1985 | Lehnhoff | 318/285 |
| 4,575,662 | A | * | 3/1986 | Lehnhoff | 318/282 |
| 4,678,975 | A | * | 7/1987 | Vrabel et al. | 318/266 |
| 4,683,975 | A | * | 8/1987 | Booth et al. | 180/289 |
| 4,962,337 | A | * | 10/1990 | Creed | 318/280 |
| 5,133,399 | A | | 7/1992 | Hiller et al. | |
| 5,434,487 | A | | 7/1995 | Long et al. | |
| 5,482,100 | A | | 1/1996 | Kuhar | |
| 5,572,101 | A | * | 11/1996 | Rutkowski et al. | 318/470 |
| 5,701,063 | A | * | 12/1997 | Cook et al. | 318/469 |
| 5,731,675 | A | * | 3/1998 | McCarthy | 318/469 |
| 5,889,377 | A | | 3/1999 | Mao | |
| 6,082,433 | A | | 7/2000 | Vafaie et al. | |
| 6,144,177 | A | | 11/2000 | Mao | |
| 6,733,413 | B2 | | 5/2004 | Lagarde et al. | |
| 7,417,397 | B2 | | 8/2008 | Berman et al. | |
| 2004/0061462 | A1 | * | 4/2004 | Bent et al. | 318/280 |

* cited by examiner

MOTORIZED BARRIER ADJUSTMENT APPARATUS AND METHOD

FIELD OF THE INVENTION

This invention relates to a motorized barrier adjustment apparatus and method. In particular, in accordance with one embodiment, the invention relates to a motorized barrier adjustment apparatus including a barrier. A controllable motor is connected with the barrier, the controllable motor conformed to detect motion of the barrier such that movement of the barrier within a predetermined amount activates the motor to move the barrier and where movement of the barrier beyond the predetermined amount does not activate the motor such that the barrier remains where it is moved. In another embodiment, a motorized barrier adjustment apparatus for covering an opening in a structure includes a barrier stored on a barrier storage tube connected with the structure above the opening. A motor is connected with the barrier and a gear reducer is connected with the motor. A controller is connected with the motor where the controller is conformed to detect motion of the barrier such that upon manual movement of the barrier within a predetermined amount the controller activates the motor to move the barrier and where upon manual movement of the barrier beyond the predetermined amount the controller does not activate the motor such that the barrier remains where it is moved. A power source is connected with the controller and the motor where the motor and the gear reducer are contained within the barrier storage tube.

BACKGROUND OF THE INVENTION

A difficulty arises in the use of protective barriers when a user desires to adjust the location of the barrier. For example only and not by way of limitation, structures with openings, such as buildings with windows, for example, very often include window shades. Normally the window shades are adjustable. They may be raised or lowered manually by means of draw strings and such. They may also be raised or lowered mechanically by use of motors operated by switches or remote controls. It is often difficult to manually raise and lower window shades to their full limits and it can be time consuming as well. Likewise, switch operated motor driven shades are subject to failure and are expensive to install and maintain.

By way of example, the prior art known to the Applicants includes devices that do not include cumbersome and dangerous pull cords, to their advantage, but are counterbalanced, manually operated devices only. U.S. Pat. Nos. 6,733,413 to Lagarde et al., 5,133,399 to Hiller et al. and 5,482,100 to Kubar exemplify the state of the art of these types of devices.

Other prior art devices include mechanical, motor operated devices that employ switches that can become damaged or deteriorate over time and are costly and time consuming to install such as the drapery actuator disclosed in U.S. Pat. Nos. 5,889,377 and 6,144,177 to Mao or the interconnected switches and sensors used to open and close a flexible curtain rollup door as in U.S. Pat. No. 6,082,433 to Vafaie et al. A serious drawback to these prior art motor operated systems is that, when the motor fails or the power goes out, the system is essentially locked in place. That is, the system must be disassembled and disconnected in order for a user to move the system without power.

Another U.S. Pat. No. 5,434,487 to Long et al., discloses a power operating system for a vehicle door for a van that includes a motor operable to power the door open or closed.

When a manual movement of the van door a certain distance is detected while the motor is inactive, the motor is energized so as to move the door in the direction of the detected movement to complete the manually initiated door movement. As van doors are required to be either open or shut there is no provision for partial movement to a partially open or partially shut position. That is, Long et al. provides that any manual movement beyond a certain amount will activate a motor to power the door fully open or fully closed. Another U.S. Pat. No. 7,417,397 to Berman et al., discloses an automated shade system that uses software to monitor solar penetration and heat gain and such and to adjust shades as needed to control interior lighting and temperature.

Thus, while both manually operated and motorized devices are known, there is a need in the art for a simple, easy to install, easy to use and easy to maintain apparatus and method for a combination manual and motorized barrier adjustment device. It therefore is an object of this invention to provide a motorized barrier adjustment device that has no expensive switches and that can be operated manually and by motor to enable a user to exactly position a window barrier in any desired location along a window, for example only.

SUMMARY OF THE INVENTION

Accordingly, the motorized barrier adjustment apparatus of the present invention, according to one embodiment, includes a barrier. A controllable motor is connected with the barrier, the controllable motor is conformed to detect motion of the barrier in the normal direction of travel such that movement of the barrier within a predetermined amount activates the motor to move the barrier and where movement of the barrier beyond the predetermined amount does not activate the motor such that the barrier remains where it is moved.

As used herein, the term "barrier" includes its common meaning and is given its ordinary definition. By way of example only, the barrier of the present invention includes covering for openings in structures. In particular, but not by way of limitation, a barrier of the present invention includes a window shade for use in covering a window in a structure, such as a residential or commercial building. Obviously, any type of barrier may be accommodated. A pliable, resiliently flexible material such as described in co-pending U.S. patent application Ser. No. 11/190,144 is preferred but, again, any type of barrier now known or hereafter developed is suitable.

According to other aspects of this invention, a counterbalance is connected with the barrier and the controllable motor can be back driven. As used herein, the term "back driven" is used in its common manner. That is, it describes a motor that is capable of rotating in either direction. By contrast, motors that are not capable of being back driven are essentially locked in position when power is not present. Applicant's back driven motor can be moved safely without power in either direction thus preventing the need to disassemble the system in the event no power is available.

In another aspect, the predetermined amount is selected from a group including: time and distance. In one aspect, the predetermined amount of time is approximately one second and the predetermined amount of distance is approximately one inch. In a further aspect, an extension rod is connected with the barrier. In a further aspect, the extension rod is connected with the barrier with a bias so that it is easy to grip and is hinged to allow it to fold out of the way.

In one aspect, the controllable motor moves the barrier a maximum amount in the direction of initial movement of the barrier. In another aspect, the barrier surrounds a barrier storage tube and the controllable motor is contained within the barrier storage tube. In a further aspect, many barriers and controllable motors connected with each other such that movement of one barrier results in proportionally identical movement of the other barriers.

According to another embodiment of the invention, a motorized barrier adjustment apparatus for covering an opening in a structure includes a barrier stored on a barrier storage tube connected with the structure above the opening. A motor is connected with the barrier. A gear reducer and a controller are connected with the motor where the controller is conformed to detect motion of the barrier such that upon manual movement of the barrier within a predetermined amount the controller activates the motor to move the barrier and where upon manual movement of the barrier beyond the predetermined amount the controller does not activate the motor such that the barrier remains where it is moved. A power source is connected with the controller and the motor and the motor and the gear reducer are contained within the barrier storage tube.

In another aspect of the invention, a counterbalance is connected with the barrier and the motor can be back driven. In a further aspect, the predetermined amount is selected from a group including: time and distance. In another aspect, the controller stores time counts and distance counts. In one aspect, the time counts are produced by a clock in the controller. In another aspect, the distance counts are generated by commutator pulses from the motor. In a further aspect, many barriers are connected with each other such that movement of one barrier results in proportionally identical movement of the remaining barriers.

In accordance with another embodiment of the invention, a motorized barrier adjustment method for covering an opening in a structure includes the steps of providing a barrier stored on a barrier storage tube connected with the structure above the opening with a motor connected with the barrier, a gear reducer connected with the motor, a controller connected with the motor where the controller is conformed to detect motion of the barrier such that upon movement of the barrier within a predetermined amount the controller activates the motor to move the barrier and where upon movement of the barrier beyond a predetermined amount the controller does not activate the motor such that the barrier remains where it is moved and a power source connected with the controller and the motor where the barrier, the motor and the gear reducer are contained within the barrier storage tube; and moving the barrier within the predetermined amount.

According to another aspect of the invention the method includes the step of not moving the barrier within the predetermined amount and instead moving the barrier beyond the predetermined amount. In another aspect, a counterbalance is connected with the barrier and the motor can be back driven. In a further aspect, the method includes connecting many barriers with each other such that movement of one barrier results in proportionally identical movement of the remaining plurality of barriers; and moving one of the bathers.

DESCRIPTION OF THE DRAWINGS

Other objects, features and advantages of the present invention will become more fully apparent from the following detailed description of the preferred embodiment, the appended claims and the accompanying drawings in which:

DETAILED DESCRIPTION OF THE INVENTION

Figure 1:
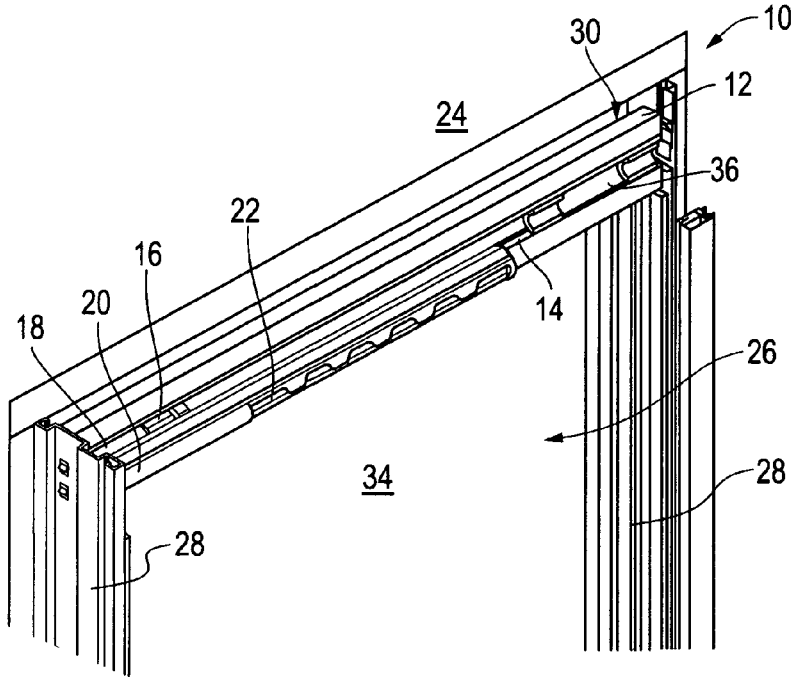
FIG. 1 is a perspective partial cut away view of the motorized barrier adjustment apparatus according to one embodiment.

The preferred embodiment of the present invention is illustrated by way of example in FIGS. 1-7. With specific reference to FIGS. 1 and 2, the motorized barrier adjustment apparatus 10 according to a preferred embodiment, includes a barrier 12. Barrier 12 preferably essentially surrounds and is wrapped or wound around barrier storage tube 14. Located within barrier storage tube 14 are motor 16 and gear reducer 18. A motor controller 20 is provided. A power supply 22, such as batteries for example, is connected with motor 16 and motor controller 20 all as will be more fully described hereafter. Needless to say, power supply 22 may be any type of power source now known or hereafter developed for providing local power to the apparatus. According to a preferred embodiment, motorized barrier adjustment apparatus 10 is used with structures 24, such as a residential or commercial building, for example only, with openings 26, such as windows, with side jambs 28 and a top 30 of the opening 26 and a bottom 32 again for example only. Opening 26 is typically sealed with glass 34 or glazing of some sort. As illustrated therefore, preferably, motorized barrier adjustment apparatus 10 is connected with the structure 24 on the inside of the structure 24 at the top 30 of the opening 26 and in front of the glass 34.

Figure 2:
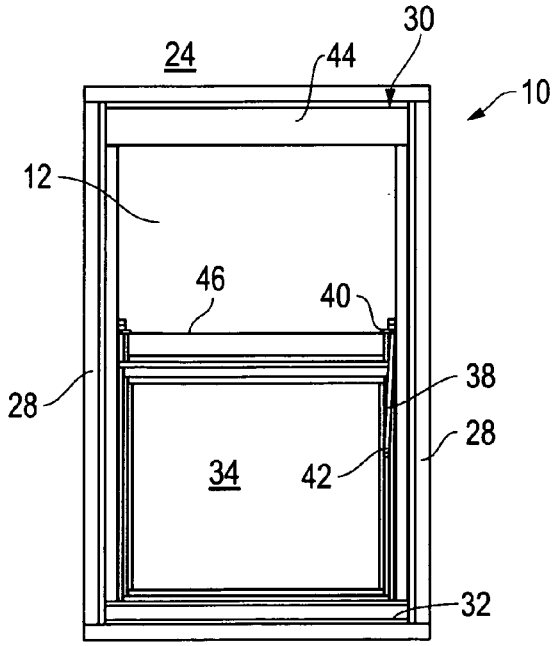
FIG. 2 is a front view of the invention of FIG. 1 with the barrier in a partially down position.

FIG. 1 also illustrates counterbalance 36 also located within barrier storage tube 14. Counterbalance 36 is any type of counterbalance, such as a torsion spring, now known or hereafter developed. FIG. 2 also illustrates extension rod 38. Extension rod 38 is connected with barrier 12 at a bias as illustrated. That is, extension rod 38 is biased to extend away from side jamb 28 to allow sufficient room for a user to grip the extension rod 38 quickly and easily. Extension rod 38 enables a user to manually move barrier 12 even when barrier 12 is in the fully up position shown in FIG. 1 and at the upper limit of the travel of barrier 12. Additionally, extension rod 38 is connected by hinge 40 with barrier 12. Hinge 40 functions to allow extension rod 38 to swivel or rotate upon contact with the bottom 32 of opening 26 as will be discussed more fully with regard to FIGS. 3 and 4. Hinge 40 is any type of hinge device now known or hereafter developed. Importantly, extension rod 38 includes a beveled tip 42 that aides in the rotation of extension rod 38 by creating a rounded, beveled "slippery surface" contact area.

Figure 3:
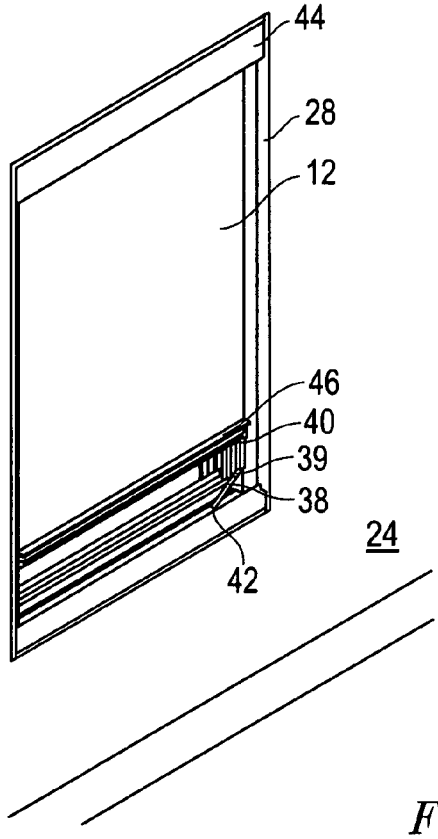
FIG. 3 is a front perspective view of the invention of FIG. 1 with the barrier near the lower limit and covering the window and the extension rod folding away.
Figure 4:
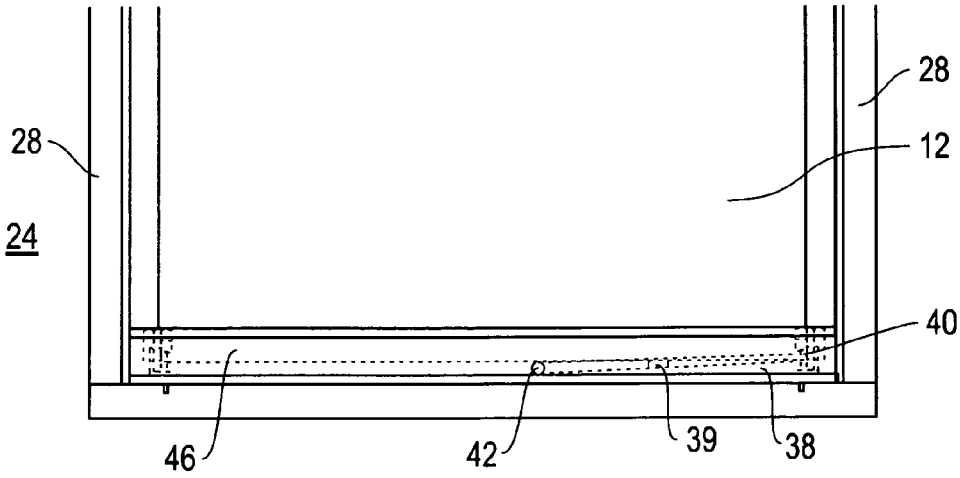
FIG. 4 is an enlarged front view from FIG. 3 showing the position of the extension rod when the barrier is at the lower limit.

FIG. 2 also illustrates upper cover 44 used as a cosmetic shield of the apparatus when in the fully raised position. Further, bottom bar 46 is connected with the barrier 12. Bottom bar 46 adds weight and rigidity to the leading end of barrier 12. Bottom bar 46 may be attached to the back of barrier 12 or sewn between layers of barrier 12 and thus be kept from direct observation Referring now to FIGS. 3 and 4, motorized barrier adjustment apparatus 10 is shown near its lower limit position in FIG. 3 and at its lower limit in FIG. 4. In FIG. 3, bottom bar 46 is near the bottom 32 of opening 26 and the combination of the beveled tip 42 of extension rod 38 and hinge 40 cause extension rod 38 to begin to fold itself parallel to the bottom 32 and behind bottom bar 46 and barrier 12. FIG. 3 also shows an aspect of the invention including a central flexible hinge 39 in the middle of extension rod 38. Flexible hinge 39 essentially divides extension rod 38 into two rigid sections on either side of hinge 39. Hinge 39 facilitates the folding of extension rod 39 from a vertical position to a horizontal position. Thus, as shown in FIG. 4, extension rod 38 (shown in dashed lines) is efficiently directed from a vertical hanging position to a horizontal position that is hidden from view when the barrier 12 is at its lower limit. FIG. 4 also shows bottom bar 46 in dashed lines indicating that it is connected behind or between barrier 12, as mentioned above, so that it is not visible.

Figure 5:
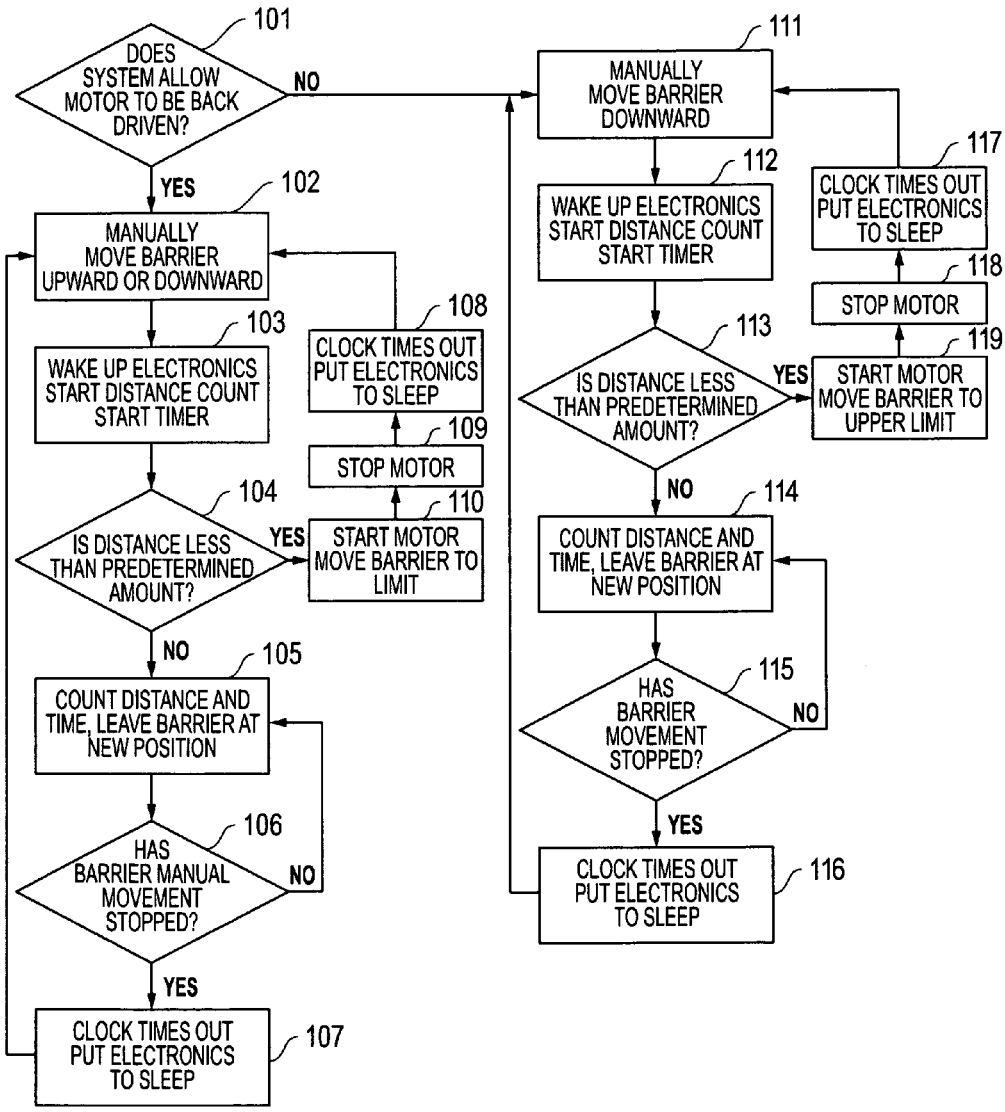
FIG. 5 is an operation flowchart of the invention of FIG. 1.
Figure 6:
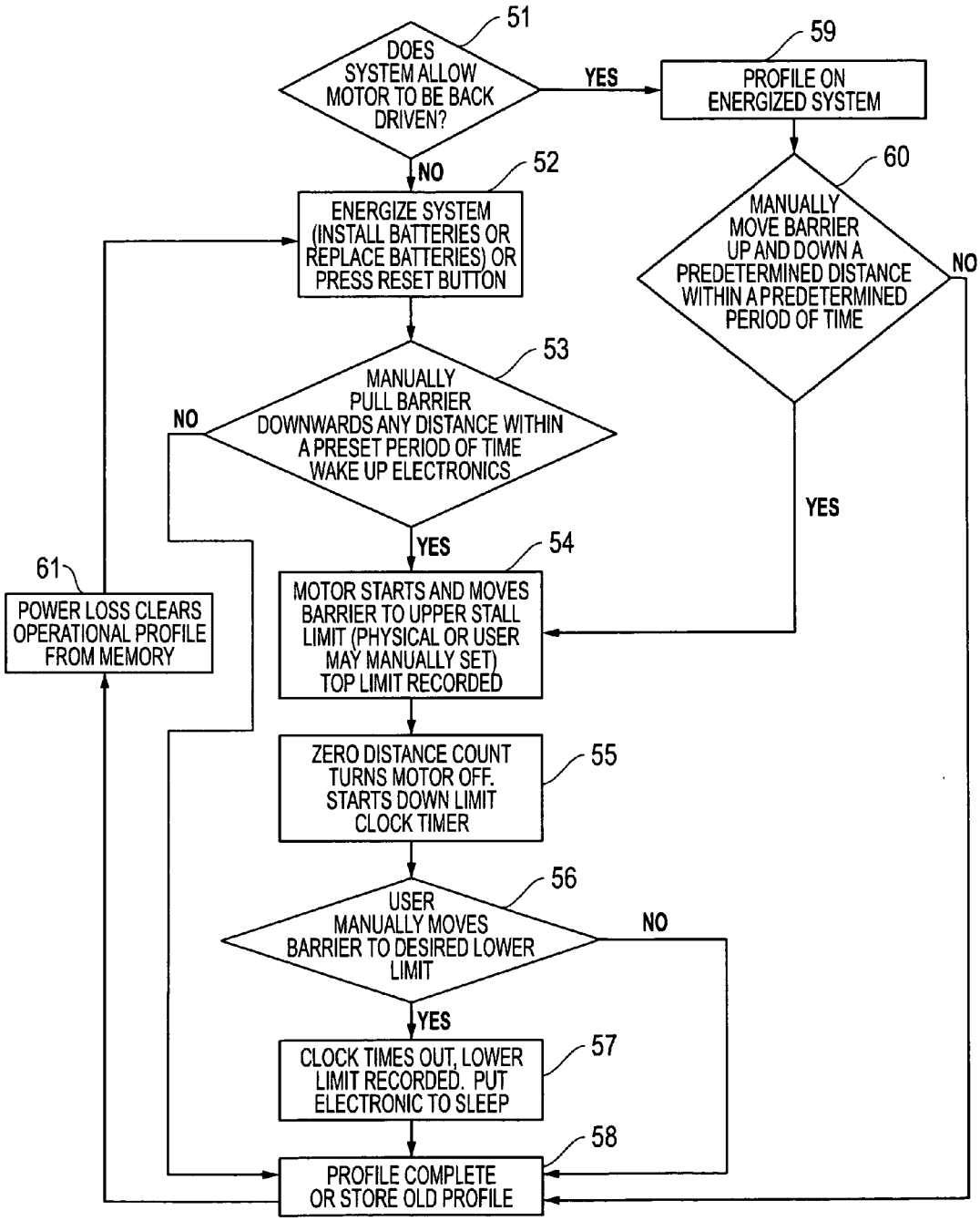
FIG. 6 is a profiling/set up chart of the invention of FIG. 1.

Referring now to FIG. 5, the operation of the motorized barrier adjustment apparatus 10 is disclosed. Applicants have created a system that is divided into two operations, the first is for systems that include counterbalances 36 and motors 20 that can be back driven. The second is for systems that include motors 20 that can not be back driven.

Going to FIG. 5 starting at step 101 for systems that can be back driven, to initiate movement of the barrier 12 the user can move the barrier 12 either up or down at step 102. This wakes up the motor controller 20 at step 103 and starts the time and distance counts. At step 104 a determination is made whether the distance or time was less than a predetermined amount, if the answer was yes the process moves to step 110 starts the motor 16 and moves the barrier 12 in the direction of the initial movement to the profile stored in the motor controller 20. Once the limit is reached the motor 16 is stopped at step 109 and at step 108 the timer times out and the process goes to sleep. If, however, at step 104 the movement of the barrier 12 is greater than the predetermined distance or time the process moves to step 105 and the motor controller 20 does not start the motor 16 and counts the distance and time of the new position of the barrier 12 then moves to step 106. In step 107 the timer times out and the motor controller 20 goes to sleep.

At step 101, if the system is not counterbalanced and the motor 16 and the gear reducer 18 can not be back driven then the process goes to step 111 where the barrier 12 can only be moved in the downward direction. At step 112 the motor controller 20 is awakened and starts a distance and time count. At step 113 the motor controller 20 determines if the distance or time counts are less than a predetermined amount and, if they are, the process moves to step 119 starts the motor 16 and moves the barrier 12 to the upper limit then stops the barrier 12 at step 118. At step 117 the timer times out and the motor controller 20 goes to sleep.

At step 113, if the count of time or distance is greater than the predetermined amount the process moves to step 114 where the motor controller 20 does not run the motor but the time and distance count are recorded and the barrier 12 stays in the new position. Once the barrier 12 stops at step 115, the process moves to step 116 where the timer times out and the motor controller 20 goes to sleep. With either drive system, the auto height adjustment will function in the same manner.

Figure 7:
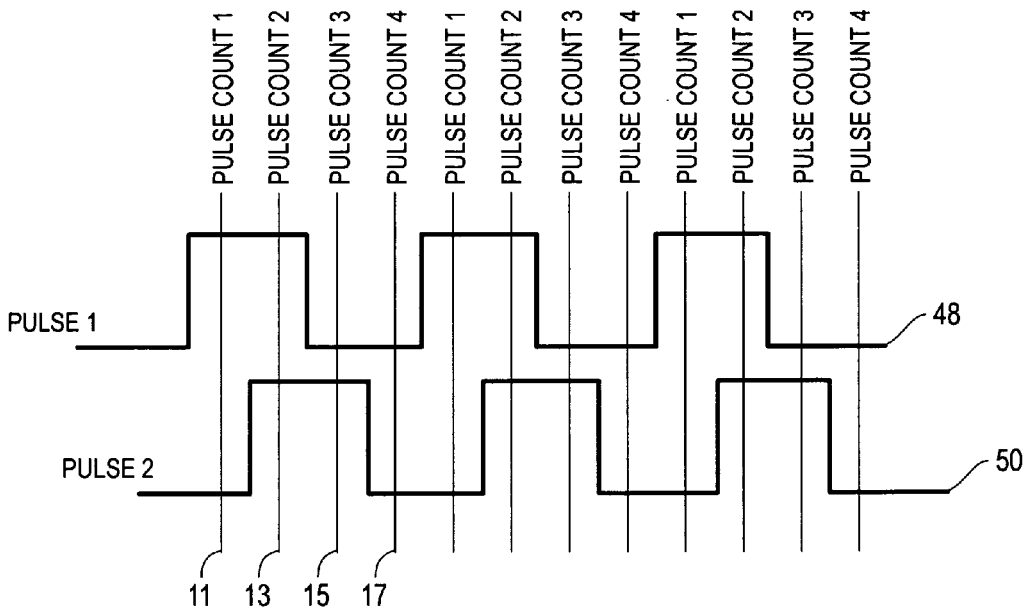
FIG. 7 is a diagram of the impulse logic from the motor of the invention of FIG. 1.

Referring next to FIG. 7, the profile sequence is discussed. Beginning in step 51, the motor controller 20 determines whether the barrier 12 can be back driven. It then moves to step 59 which allows an energized device 10 to be re-profiled. In step 60 the barrier 12 can be moved either up or down within a predetermined period of time, such as one second, or within a predetermined distance, such as one inch. If the barrier 12 has not moved, the program moves to step 58. If the barrier 12 has moved, the process moves to step 54 and the motor 16 starts and moves the barrier 12 to its upper limit determined by either a stall induced by the manner of the connection of the apparatus with the structure 24 or a physical stall by the user and the top limit is recorded in the motor controller 20. The process then goes to step 55, zeros the distance count and starts the down limit timer. At step 56 the user manually moves the barrier 12 to its lower limit and at step 57, the down timer times out, the motor controller 20 sets the lower travel limit, stores the new profile, and puts the electronics to sleep at step 58. After a loss of power or reset condition, such as pushing the reset, installing, or replacing batteries, the motor controller 20 will clear the profile stored in memory at step 61 and the operational upper limit operation cannot be carried out until a manual "profile" operation is complete. The motor controller 20 must re-establish its position by finding the top or upper limit of travel. For safety reasons, is undesirable for the motor controller 20 to start moving the barrier 12 as soon as power is restored. Once the travel limits are established, and a profile is stored, the apparatus 10 is placed in the normal operation mode and may be either operated manually or in "semi-automated" mode.

At step 51, in the case of an apparatus 10 that will not allow the motor 16 to be back driven, the system is energized by installing or replacing power supply 22, such as batteries, or pressing the reset button at step 52. Then the user then pulls the barrier 12 downward, using extension rod 38 if needed, which wakes up the electronics at step 53 and the process moves to step 54 then completes the process outlined above. Obviously, the controls can be set by the user to alter the limits inside the stall limit range. Doing so will prolong the power supply 22, battery, life as well as reduce the stress on the motor 16 and other drive components.

Quadrature encoders are known in the art and can provide direction of rotation as well as counting pulses for position determination. Obviously, sensing of manual movement of motor 16 can be accomplished in any of a number of ways as with both a comparator and with an opto-coupler. Motor controller 20 is a programmable controller known in the art that is connected electronically with motor 16 so as to detect manual movement of unenergized motor 16. For the purposes of conserving energy, this invention preferably uses a standard brush type direct current (DC) motor 16 which provides the electromotive force and a generator function. It does not need to remain under power at all times. When the barrier 12 is moved, the motor 16 connected to the barrier 12 rotates and the impulses from the motor 16 are sensed by the microprocessor software in motor controller 20 to determine both direction of rotation and angle of rotation via, for example only, brush commutations. A standard comparator circuit, for example, determines the polarity of the "motor+" and "motor−" poles providing clockwise or counterclockwise input. The comparator triggers the motor controller 20 to "wake up" and begin direction counting. The second circuit senses the brush commutations for the motor controller 20 position counting. This provides both the motor force to move the barrier 12 as well as the input to the motor controller 20 to determine barrier 12 position and direction.

Referring now to FIG. 7, the pulse counts are diagramed to describe their function. The two pulses 48 and 50 are phased where pulse count 1 reads the high of both pulses followed by pulse count 2 that reads the high of pulse 48 and the low of pulse 50. Next the pulse count 3 reads the low of both pulses and pulse count 4 reads the low of pulse 48 and the high of pulse 50 then the pulse counts repeat themselves. With this method the motor controller 20 determines direction of movement as well as time and distance.

By way of continued explanation, in a preferred embodiment, motorized barrier adjustment apparatus 10 includes protective barrier 12 mounted on the interior side of the glazing 34 rather than the exterior. The interior mounted barrier 12 does not necessarily include a mechanical locking feature incorporated into the bottom bar 46 of the barrier 12 and the bottom 32 sill portion of the frame of opening 26. However, it does provide a locked and unlocked state by design. The system has a motor 16 and gear reducer 18 with lower torque output resulting from a gear box design with a more efficient, less reduction, and slower turning electric permanent magnet direct current (PMDC) motor. When moving the barrier 12 there is parasitic drag from the motor 16, the gear reducer 18, the weight of the barrier 12, and the inertia of the barrier storage tube assembly 14. This parasitic drag can be counterbalanced to provide for a system that can be manually moved with the motor 16 and the gear reducer 18 always connected to the barrier storage tube 14. With proper counterbalancing achieved, in the preferred embodiment a torsion spring 36 is used, any manual movement of the barrier 12 in either the upward or downward direction causes the barrier storage tube 14 to turn thereby "waking up" the electronics in the motor controller 20. These factors combined with the ability to "wake up" the motor controller 20 on a manual movement of the barrier 12, which is detected electronically as described above, produces an operational mode that could be referred to as "semi-automated". In this semi-automated mode the user can manually start the movement of the barrier 12. With a pull in the downward direction of the barrier 12 to indicate to the motor controller 20 that a move to the closed position is desired or a push upward of the barrier 12 in the upward direction to indicate that a move to the open position is desired. This is determined through the first initial movement of the barrier 12 and can be timed for a predetermined period of time, such as one second, or determined if the distance the barrier 12 has traveled is less than a predetermined distance, such as 1 inch, the motor controller 20 will wake up, start the motor 16 and power the barrier 12 to its limit position, in the direction of the initial movement, shut down, and put the motor controller 20 back to sleep.

Alternately, the user can carry out a complete manual positioning of the barrier 12, provided they manually move the barrier 12 for a time period greater than the predetermined time period or displace the barrier 12 by a distance greater than the predetermined distance outside the region of automatic movement, referred to as the predetermine time or distance. In this manual operation, the barrier 12 can be manually moved to a new position without the motor controller 20 starting the motor 16 and the barrier 12 remains in that new position with the motor controller 20 still asleep. However, if the user desires to move the barrier 12 to a position that is inside the predetermined time or distance, the user must first manually move the barrier 12 outside the predetermined time or distance and then move it back to the desired position.

Another embodiment of the invention includes co-ordination of multiple motorized barrier adjustment apparatus 10. That is, this invention can be used on multiple bathers 12*n* of multiple heights, that is for windows of varying dimensions, when used with Zwave technology incorporating the features of Applicants' co-pending application for a Method of Wiring Devices in a Structure Using a Wireless Mesh Network. That is, by means of electronic connection, the motor controller 20 of one particular barrier 12 being adjusted becomes the master motor controller 20 and sends a position signal to the remaining "slave" barriers 12*n* in the group. If the user desires an "all-move" or "group-move" then a "trigger event" prior to, or following the manual positioning of the barrier 12 is required. Following such an action all 'grouped' units would then move their barriers 12 to the same position, such as a percentage of 'openness' (100%=open 0%=closed) as the "master unit" has established. The trigger event can, for example only, consist of some manual excursion of the barrier 12 in the opposite direction of the direction in which the user intends the final position of the barriers 12; plural because the intention is an "all-move" or "group-move". It is important to note that this method of movement is similar to a master slave arrangement but the relationship is dynamic in that any protective barrier 12 can become the master or a slave depending on the protective barrier 12 being adjusted. Said another way, the user can move any one of the protective barriers 12 in a group to either an upper limit, a lower limit, or anywhere in between the two limits and with a short tug on the protective barrier 12 being adjusted the remaining protective barriers 12 in the group communicate with the "now adjusted" protective barrier 12 and power up to move to the "same" relative height.

Still further, attached to the bottom of the barrier 12 is an extension rod 38 seen in FIGS. 2-4. The first end on the extension rod 38 is pivotally attached to the bottom bar 46 or barrier 12 and is designed to be biased away from the vertical jamb 28 such that it is convenient for the user to get their hand around and grab the extension rod 38. This biasing also facilitates the collapsing of the extension rod 38 as it contacts the sill area at the bottom 32 of opening 26. Additionally the second end of the extension rod 38 includes beveled tip 42 to further assist in the collapsing such that when the protective barrier 12 is fully closed, as shown in FIGS. 3 and 4, the extension rod 38 is no longer visible.

Preferably, a motor 16 connected to barrier storage tube 14 without a gear reduction system 18 can easily be rotated in either direction. As the desire for more compact motors emerge, the need for gear reduction increases. Gear efficiencies also are important in the differences between the amounts of power input to the amount of power output. Further if one is trying to achieve the most efficient condition, one must counterbalance the weight of the barrier 12 such that the motor 16 is only required to produce the energy needed to overcome inertia and move the barrier 12. In this most efficient condition, movement of the barrier 12 can turn the motor 16 allowing manual adjustment of the barrier 12 without the use of the motor 16 or the need to disconnect the motor 16 from the barrier storage tube 14.

In broadest terms, an object of the invention is a counterbalanced protective barrier system that automatically moves a protective barrier or covering to its upper limit when manually moved less than a predetermined amount in the upward direction and moves the protective barrier or covering to its lower limit when manually moved less than a predetermined amount in the downward direction. When the protective barrier or covering is manually moved an amount greater that the predetermined amount in either direction the covering will remain in the new position established by the manual movement. The system also includes an extension rod to assist in reaching the covering to initiate movement when the covering is normally out of reach. The extension rod collapses out of sight when the cover is closed and is biased to extend away from the jamb with sufficient room to allow one to grip the extension rod. Further, protective barriers may be electronically grouped together through a mesh network, such as a Zwave controlled network, so that they can automatically adjust their height based on the height of one protective barrier in the group, as more particularly described in co-pending U.S. patent application for a Control for Positioning Multiple Barriers Apparatus and Method filed this same day.

In particular, the motorized barrier adjustment apparatus and method of the present invention does not require externally or internally accessible switches. A user can either manually move the protective barrier 12 less than a predetermined distance and the motor 16 engages to drive the protective barrier 12 to the full extent of travel in the direction of movement or the user can move the protective barrier 12 past the predetermine distance and to the desired location where the barrier will remain as placed 12. Extension rod 38 provides a noticeable function without being noticed when the barrier 12 is in the closed position. Further, an "auto height adjustment" feature as described herein determines if the protective barriers 12 in a group are above or below the target protective barrier 12 and then adjusts them all so that they all are in the same relative position. If the user needs to move the protective barrier 12 a distance location inside the predetermined distance, they simply first move the protective barrier 12 outside the predetermined distance and then back to the desired location where the barrier 12 will remain as placed.

The description of the present embodiments of the invention has been presented for purposes of illustration, but is not intended to be exhaustive or to limit the invention to the form disclosed. The invention, for example only, is not limited to window coverings. The invention is applicable in a wide variety of uses such as in pull down projector screens and or similar devices, for example. Thus, many modifications and variations will be apparent to those of ordinary skill in the art. As such, while the present invention has been disclosed in connection with an embodiment thereof, it should be understood that other embodiments may fall within the spirit and scope of the invention as defined by the following claims.

What is claimed is:

1. A motorized barrier adjustment apparatus comprising:

a. a barrier wherein said barrier surrounds a barrier storage tube;

b. a controllable motor connected with said barrier wherein said controllable motor is contained within said barrier storage tube, said controllable motor conformed to detect motion of said barrier such that movement of said barrier within a predetermined amount activates said motor to move said barrier and wherein movement of said barrier beyond said predetermined amount does not activate said motor such that said barrier remains where it is moved.

2. The apparatus of claim 1 further comprising a counterbalance connected with said barrier and wherein said controllable motor can be back driven.

3. The apparatus of claim 2 wherein said controllable motor moves said barrier a maximum amount in the direction of initial movement of said barrier.

4. The apparatus of claim 1 wherein said predetermined amount is selected from a group consisting of: time and distance.

5. The apparatus of claim 4 wherein said predetermined amount of time is approximately one second and said predetermined amount of distance is approximately one inch.

6. The apparatus of claim 1 further including an extension rod connected with said barrier.

7. The apparatus of claim 6 wherein said extension rod is connected with said barrier with a bias and hinged to allow it to fold.

8. The apparatus of claim 1 further comprising a plurality of barriers and controllable motors connected with each other such that movement of one barrier results in proportionally identical movement of the remaining plurality of barriers.

9. A motorized barrier adjustment apparatus for covering an opening in a structure comprising:

a. a barrier stored on a barrier storage tube connected with said structure above the opening;

b. a motor connected with said barrier;

c. a gear reducer connected with said motor;

d. a controller connected with said motor wherein said controller is conformed to detect motion of said barrier such that upon manual movement of said barrier within a predetermined amount said controller activates said motor to move said barrier and wherein upon manual movement of said barrier beyond said predetermined amount said controller does not activate said motor such that said barrier remains where it is moved; and e. a power source connected with said controller and said motor wherein said motor and said gear reducer are contained within said barrier storage tube.

10. The apparatus of claim 9 further comprising a counterbalance connected with said barrier and wherein said motor can be back driven.

11. The apparatus of claim 9 wherein said predetermined amount is selected from a group consisting of: time and distance.

12. The apparatus of claim 11 wherein said controller stores time counts and distance counts.

13. The apparatus of claim 12 wherein said time counts are produced by a clock in said controller.

14. The apparatus of claim 12 wherein said distance counts are generated by commutator pulses from said motor.

15. The apparatus of claim 9 further comprising a plurality of barriers connected with each other such that manual movement of one barrier results in proportionally identical movement of the remaining plurality of barriers.

16. A motorized barrier adjustment method for covering an opening in a structure comprising:

a. providing a barrier stored on a barrier storage tube connected with said structure above the opening with a motor connected with said barrier, a gear reducer connected with said motor, a controller connected with said motor wherein said controller is conformed to detect motion of said barrier such that upon movement of said barrier within a predetermined amount said controller activates said motor to move said barrier and wherein upon movement of said barrier beyond a predetermined amount said controller does not activate said motor such that said barrier remains where it is moved and a power source connected with said controller and said motor wherein said barrier, said motor and said gear reducer are contained within said barrier storage tube; and b. moving said barrier within said predetermined amount.

17. The method of claim 16 further comprising not moving said barrier within said predetermined amount and instead moving said barrier beyond said predetermined amount.

18. The method of claim 16 further comprising a counterbalance connected with said barrier and wherein said motor can be back driven.

19. The method of claim 16 further comprising:

a. providing a plurality of barriers connected with each other such that manual movement of one barrier results in proportionally identical movement of the remaining plurality of barriers; and b. moving one of said barriers.

* * * * *

UNITED STATES PATENT AND TRADEMARK OFFICE

CERTIFICATE OF CORRECTION

PATENT NO. : 8,125,167 B1
APPLICATION NO. : 12/287001
DATED : February 28, 2012
INVENTOR(S) : Willis Jay Mullet et al.

It is certified that error appears in the above-identified patent and that said Letters Patent is hereby corrected as shown below:

In column 3, line 55 “bathers” should read: barriers.

In column 7, line 55 “bathers” should read: barriers.

Signed and Sealed this
Fifteenth Day of May, 2012

David J. Kappos

David J. Kappos
*Director of the United States Patent and Trademark Office*